US005546292A

United States Patent [19]

Shemitz

[11] Patent Number: 5,546,292

[45] Date of Patent: Aug. 13, 1996

[54] HOSPITAL CORRIDOR LIGHTING/INFORMATION UNIT AND SYSTEM

[75] Inventor: Sylvan R. Shemitz, Woodbridge, Conn.

[73] Assignee: Sylvan R. Shemitz Designs, Inc., West Haven, Conn.

[21] Appl. No.: 289,217

[22] Filed: Aug. 12, 1994

[51] Int. Cl.[6] ..... F21V 33/00

[52] U.S. Cl. ..... 362/234; 362/20; 362/147; 362/154

[58] Field of Search ..... 362/20, 147, 154, 362/234, 236, 242, 243; 40/553, 558

[56] References Cited

U.S. PATENT DOCUMENTS

| | | | |
|---|---|---|---|
| 2,478,825 | 8/1949 | Huegel | 240/73 |
| 2,517,119 | 8/1950 | Le Duc | 177/329 |
| 2,845,322 | 7/1958 | Squindo | 312/233 |
| 3,803,396 | 4/1974 | Damico | 240/2 R |
| 4,104,710 | 8/1978 | Damico et al. | 362/234 X |
| 4,394,718 | 7/1983 | Balzer | 362/278 |
| 4,736,280 | 4/1988 | Simidian | 362/80 |
| 4,752,863 | 6/1988 | Parrott | 362/128 |
| 5,025,355 | 6/1991 | Harwood | 362/147 |
| 5,165,780 | 11/1992 | Katz | 362/147 |

*Primary Examiner*—Stephen F. Husar
*Attorney, Agent, or Firm*—Fish & Neave; Jeffrey H. Ingerman

[57] ABSTRACT

A combination lighting/information unit, particularly but not exclusively for use in hospital corridors, and a corridor lighting system incorporating such units, has been provided. The wall-mounted unit provides both upward indirect and downward direct lighting, as well as secure storage for charts and an attractive mounting for room numbers and similar indicia which may be transilluminated by the lighting components. In a system incorporating such units, one unit is mounted outside every room, and the downward lighting is connected to the emergency power supply for uniformly distributed emergency lighting.

26 Claims, 4 Drawing Sheets

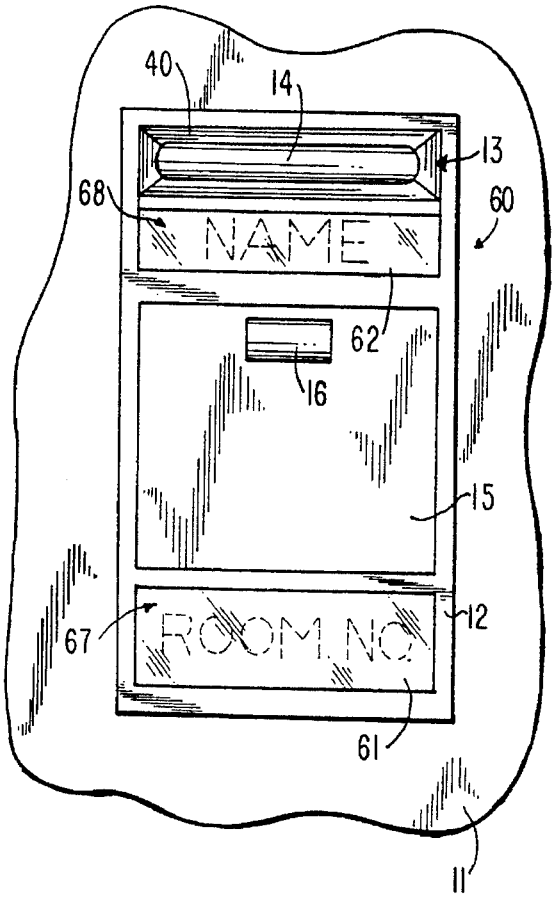
FIG.6
FIG.7
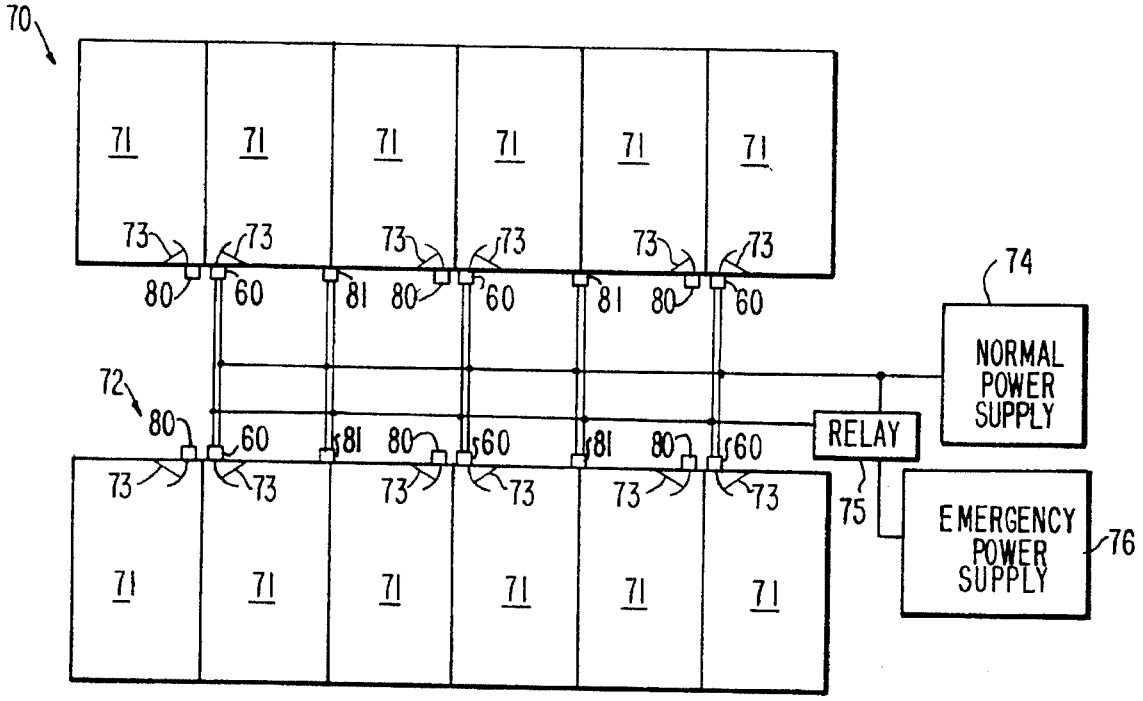

HOSPITAL CORRIDOR LIGHTING/INFORMATION UNIT AND SYSTEM

BACKGROUND OF THE INVENTION

This invention relates to combination lighting/information units, and particularly to lighting/information units for use in hospital corridors, and to a corridor lighting system incorporating such units.

Corridors in hospitals, clinics and similar medical facilities are commonly lighted by ceiling-mounted fluorescent lamps. Although the lamps are usually covered by some type of diffuser or shield, the result is a relatively harsh form of lighting, with discomfort glare and disability veiling glare.

At the same time, hospital room numbers and other room identifiers (e.g, department name, doctor name, or patient name, depending on the type of room or office) are provided on signs mounted on the room doors or on the walls adjacent the doors. Those signs may be difficult to read under emergency lighting conditions. In particular, hospital emergency power systems are generally not sufficient to light all of the ceiling lamps in a corridor. Therefore, in case of a failure of the normal electrical power supply system, whether limited to the hospital or more widespread, only a fraction of the lamps are energized by the emergency power system, leaving relatively long stretches of corridor with little illumination. Alternatively, incandescent wall-mounted emergency lights may be provided, also at relatively infrequent locations.

Finally, patients medical charts are kept by different hospitals in a number of different places. One common place to keep the chart is on a hook at the foot of the patient's bed. In that case, the physician is unable to study the chart before entering the room, and must stand in the room reviewing the chart, possibly disturbing the patient and visitors unnecessarily. Alternatively, the chart could be kept outside the room, hanging on a hook on the door or wall, or in a pocket attached to the wall. However, the chart, or the pocket, is then subject to being knocked down by passersby in the corridor.

Thus, it would be desirable to be able to provide a hospital corridor lighting system that provides plentiful, comfortable, indirect lighting.

It would also be desirable to be able to provide secure patient chart storage that allows a physician to retrieve and study a patient's chart before entering the room.

It would further be desirable to be able to provide a room identification marker that is legible even under emergency lighting conditions.

It would still further be desirable to be able to provide a better distribution of emergency lighting in hospital corridors.

SUMMARY OF THE INVENTION

It is an object of this invention to provide a hospital corridor lighting system that provides plentiful, comfortable, indirect lighting.

It is also an object of this invention to provide secure patient chart storage that allows a physician to retrieve and study a patient's chart before entering the room.

It is a further object of this invention to provide a room identification marker that is legible even under emergency lighting conditions.

It is a still further object of this invention to provide a better distribution of emergency lighting in hospital corridors.

In accordance with the present invention there is provided a lighting/information unit for mounting at a location on a wall of a building interior space. The unit comprises a body for mounting on the wall, a first light source within the body for projecting light substantially upward and illuminating the space, a second light source within the body for projecting light substantially downward and illuminating the space, a compartment within the body for storing information related to the location, and a closure for the compartment, the closure being operable from the space for opening and closing the compartment. There may also be indicia on the unit containing additional information about the location.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 6 is a front elevational view, similar to FIG. 2, of an alternate embodiment of the combination lighting/information unit according to the invention;

FIG. 7 is a schematic plan view of a lighting/information system in accordance with the present invention.

DETAILED DESCRIPTION OF THE INVENTION

Figure 1:
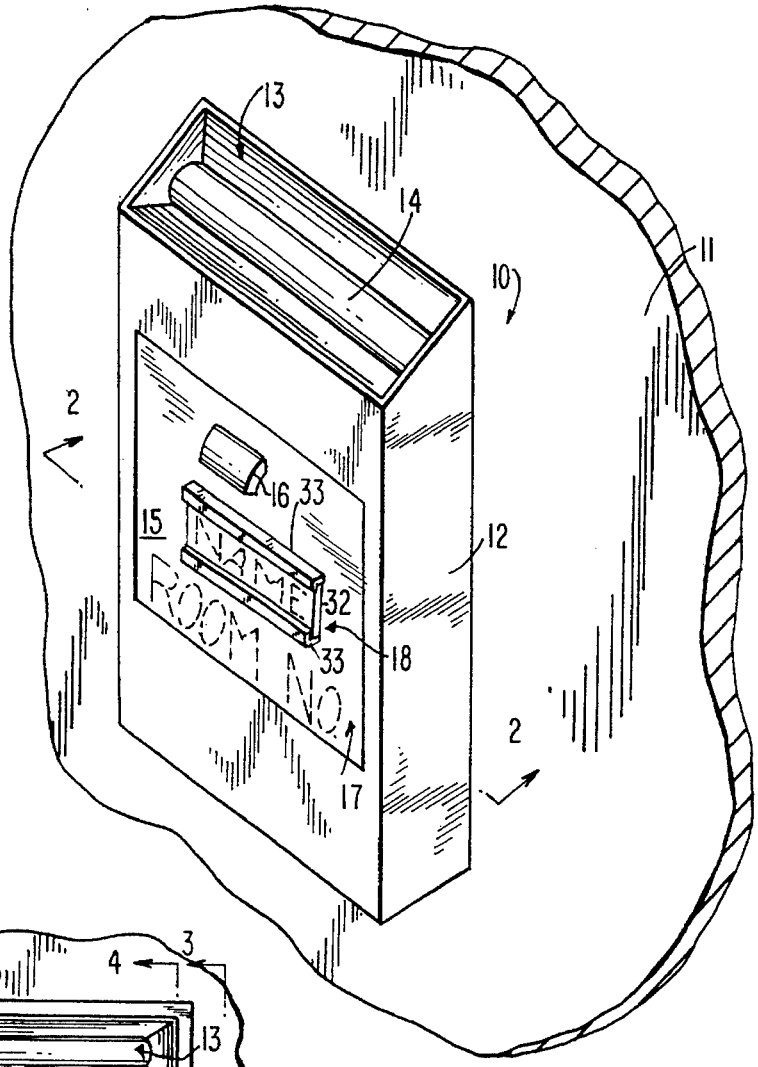
FIG. 1 is a top, right, front, partially fragmentary perspective view of a combination lighting/information unit according to the present invention mounted on a wall.
Figure 2:
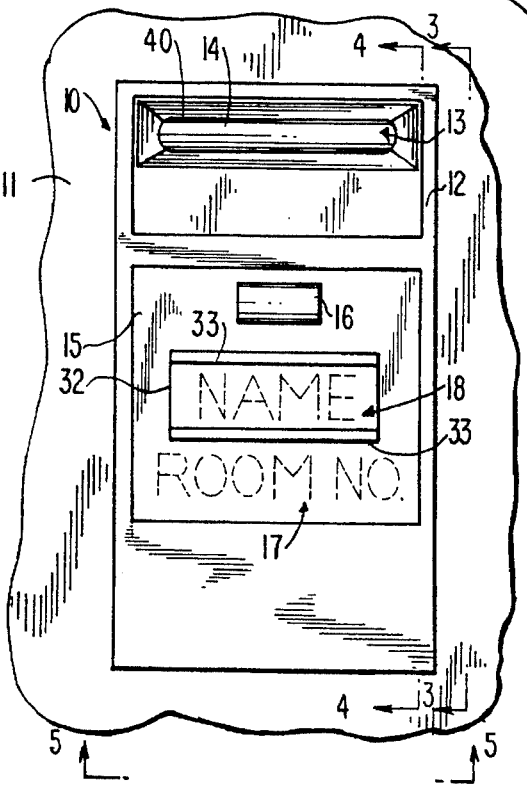
FIG. 2 is a front elevational view of the combination lighting/information unit of FIG. 1, taken from line 2–2 of FIG. 1.
Figure 3:
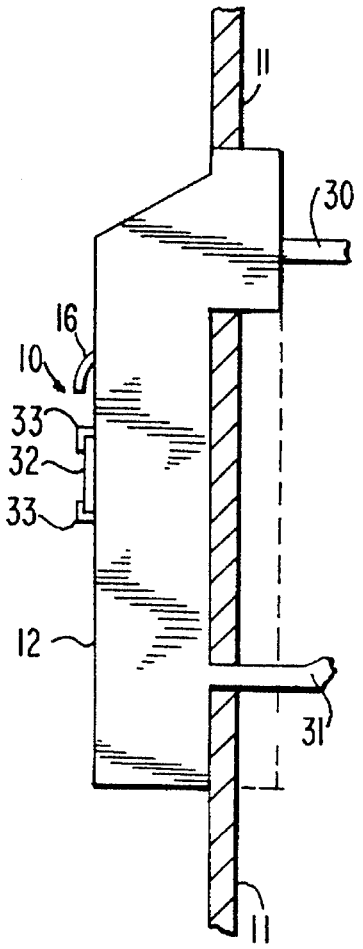
FIG. 3 is a side elevational view, partly in cross section, of the combination lighting/information unit of FIGS. 1 and 2, taken from line 3—3 of FIG. 2.

The present invention is a wall-mounted lighting unit for a building interior space that also provides for display and storage of printed information. In particular, the combination lighting/information unit has a compartment in which printed records, preferably associated with something located near the unit, can be stored. In addition, the unit has provisions for the display of printed information on its exterior surface, preferably related to something located near the unit, such as the room numbers and names of people in a room adjacent the unit. In one embodiment, those displays can be transilluminated by the light sources in the unit.

The unit may be mounted on the surface of the wall, or may be partially recessed into the wall. If the unit is partially recessed into the wall, the storage compartment can be made accessible from both sides of the wall. Even where the unit is surface-mounted, it is preferably of sufficiently low profile (e.g. four inches or less) that passersby will not collide with it.

The unit is preferably designed to provide both indirect and direct lighting for the space in which it is mounted. Thus, the unit is preferably equipped with two light sources, one of which is aimed upward preferably to illuminate the ceiling of the space and thus provide indirect lighting, and the other of which is preferably aimed downward toward the floor. In one preferred embodiment, the upward facing light source is the primary light source, and is preferably a metal halide lamp or a fluorescent or other high efficacy source, while the downward facing light source is a secondary light source, and is preferably one or more compact fluorescent lamps. If the lower portion of the unit is recessed in the wall, the secondary light source may be more in the nature of "aisle-type" lighting, and may be baffled.

The invention is particularly well-suited for use in hospitals, clinics and similar medical facilities, and especially in corridors leading to patient rooms. In such a setting, the displayed information on the exterior of the unit would preferably be the room number and the patient name, while the compartment would preferably be used to store the patient's medical chart. The physician or other health-care professional could remove the chart from the compartment and study it before entering the patient room. The downward-facing light source could serve as a task or reading light for that purpose, particularly if the upward facing light source is not illuminated for any reason (see below). If access from within the room is possible, as discussed above, the professional could return the chart to the compartment from inside the room before exiting; otherwise, he or she would return the chart after exiting.

Of course, units according to the invention could be used in other parts of the medical facility, such as outside physicians' offices or departmental offices. In such a case, the storage compartment may not be as useful, but the displayed information, especially if transilluminated, would be useful. And there could still be uses for the storage compartment in such a case, or even in a non-medical facility. For example, a list of people to contact in case of an emergency associated with that department might be concealed in the compartment. Or, if there is a particular piece of equipment nearby, the operating and maintenance instructions and logs for that equipment could be kept in the compartment.

According to another aspect of the invention, if the units are used as part of the lighting system in a facility, such as a medical facility, that has an emergency or backup power supply in case the normal power supply fails, the secondary light source in each unit, which requires much less power than the primary light source, could be connected to the backup power supply as well as to the normal power supply. The secondary light sources would then serve as the emergency corridor lighting for the facility. Because the secondary light sources preferably consume relatively little power compared to the primary light sources, it would be possible to connect every secondary light source to the backup power supply, even though such power supplies—whether an on-site generator or a bank of batteries—are generally limited in size and capacity. There would then be uniform, if low-level, lighting along the corridors in power failure situations.

A corridor lighting system according to the present invention would include as system modules such combination lighting/information units, but may also include modules having only the lighting features without the information features, as well as modules having only the information features without the lighting features. All of the modules would preferably have the same outward appearance for uniformity.

For example, if all of the rooms along a corridor were similarly configured, the room doors would be uniformly spaced along the corridor and only the combination lighting/information units would be needed as modules of the corridor lighting system to provide uniform lighting. However, if the rooms are arranged so that adjacent rooms have mirror-image configurations, then there would be an arrangement of doors along the corridor in which two doors would be very close together, separated by relatively long lengths of corridor in each direction from adjacent groups of two doors. If the system included only a combination lighting/information module at each door, there might be too much lighting adjacent the doors and not enough lighting midway between groups of doors.

In such a situation, more even lighting can be provided by having information-only modules (without lighting) at one of the two doors in each group, avoiding too much lighting at the doors. The evenness of the lighting can be improved further by providing lighting-only modules (without the displayed indicia or the storage compartment) midway between the groups of doors. Such a system could be made to appear uniform by providing combination lighting/information modules, lighting-only modules, and information-only modules having the same shape and general appearance.

A combination lighting/information unit 10 according to the invention, which also serves as a combination lighting/information module of a system according to the invention, is shown in FIGS. 1–5 along with a portion of wall 11 in which it is installed.

Unit 10 has a housing or body 12 that is mounted on wall 11. As shown in FIGS. 1–5, body 12 is essentially surface-mounted on wall 11, but partial recessed mounting is also possible as discussed above. Body 12 is preferably made of stainless steel or other suitable material, such as plastic or another metal, that can withstand occasional impacts—e.g., from passersby or from equipment being moved through the corridors—without damage. Preferably, body 12 should not have to withstand any impacts, and to that end it is formed with a low profile relative to wall 11. Unit 10 is thus able to meet the requirements of statutes and regulations—e.g., the Americans With Disabilities Act of 1992 —designed to improve access for those who might not otherwise be able to avoid a higher-profile unit, such as those in wheelchairs or the visually impaired.

Mounted within an opening 13 at the top of body 12 is primary lighting unit 40, containing primary light source 14. Lighting unit 40 is preferably a highly effective asymmetric distribution luminaire, such as Elliptipar, Inc. catalog no. M203-150D with a visor/baffle (catalog no. AVK0200), from Elliptipar, Inc., of West Haven, Conn., and light source 14 is preferably a highly efficient compact source, such as a model HQI-DE150/WDX 11,000-lumen lamp by Osram Sylvania, of Danvers, Mass. An appropriate conduit and wires, or cable 30, is provided for connection of lighting unit 40 to a remote ballast and a suitable power supply (as discussed below). Lighting unit 40 emits light in the direction of arrow A.

Secondary lighting unit 41 is preferably mounted in an opening 42 in the bottom of body 12. Lighting unit 41 includes secondary light source 43, which is preferably two double-twin-tube compact fluorescent lamps such as type F13DBX/SPX35/4P 13-watt, 900 lumen lamps by General Electric Company, of Cleveland, Ohio, mounted in a reflector 44, and having a local ballast 45 connected by conduit and wires, or cable 31, to a suitable power supply (as discussed below). Lighting unit 41 emits light in the direction of arrow B. A baffle or louver (not shown) may be provided in opening 42.

Below primary lighting unit 40 and above secondary lighting unit 41 is compartment 46, which is closed by door or closure 15. Door 15 is preferably hinged on hinge 47, which preferably is of the type that is fully concealed inside compartment 46 when door 15 is closed. Door 15 also preferably has a recessed or low-profile handle 16 to facilitate opening compartment 46. In addition, some type of latch, such as a magnetic latch (not shown), is provided to hold door 15 closed. Alternatively, hinge 47 could be spring-loaded, so that door 15 is always urged closed, or hinge 47 could be of the type that is urged closed when door 15 is in or near the closed position, but otherwise holds the position in which it is placed. To maintain the privacy of patient records, it may be necessary or desirable to provide a lock (not shown) on door 15 to which only physicians and other authorized health care providers would have the key.

Figure 4:
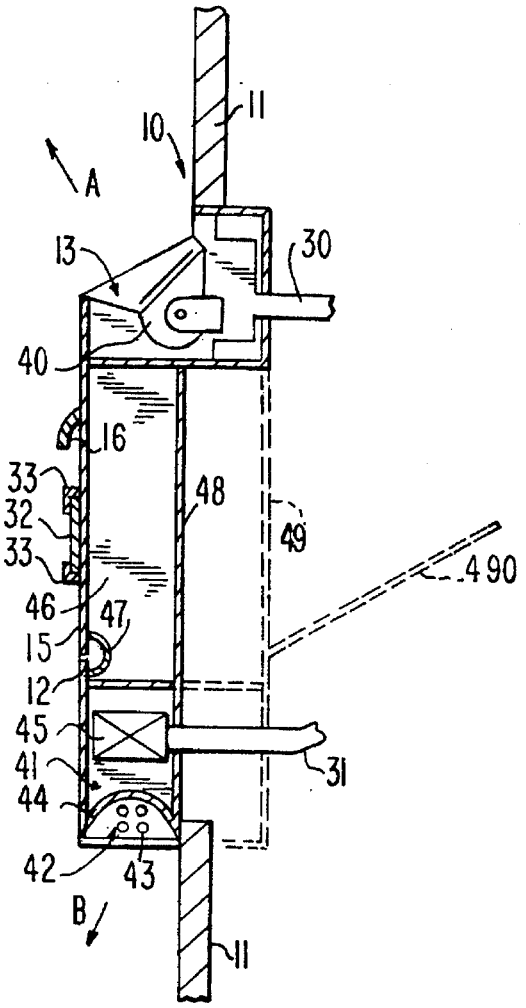
FIG. 4 is a vertical cross-sectional view of the combination lighting/information unit of FIGS. 1–3, taken from line 4—4 of FIG. 2.
Figure 5:
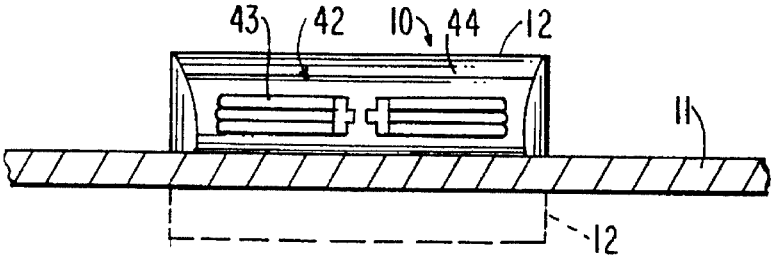
FIG. 5 is a bottom plan view, partly in cross section, of the combination lighting/information unit of FIGS. 1–4, taken from line 5—5 of FIG. 2.

As shown in FIG. 4, compartment 46 could be surface mounted or, as indicated by the dashed lines, could be recessed in wall 11, in which case door 15 would move back to the position occupied in the drawing by compartment rear wall 48, flush with wall 11, while rear wall 48 would move to the position shown in dashed lines as rear wall 49. In that configuration, a door 490 (shown in dashed lines in the open position) could be provided in rear wall 49 for access to compartment 46 from the other side of wall 11 as discussed above.

As described above, unit 10 preferably also bears indicia 17, 18 containing information related to the location in which unit 10 is installed. For example, in the hospital setting discussed above, indicium 17 could be the room number of the room outside of which unit 10 is mounted. The room number, which is substantially permanent, can be affixed to body 12, preferably on door 15, in a substantially permanent way. For example, the room number could be painted on at the time of fabrication or installation of unit 10. On the other hand, if indicium 18 is the name of the occupant of the room or office, it may change frequently, especially if it is a patient name. Therefore, indicium 18 may be provided, for example, on a removable plastic insert 32 held by rails 33. Each time it is necessary to change indicium 18, insert 32 can be slid out on rails 33 and a new insert 32 inserted.

A second preferred embodiment of a lighting/information unit 60 according to the present invention is shown in FIG. 6. Unit 60 is identical to unit 10, except that indicia 17, 18 are replaced by indicia 67, 68, respectively. Indicia 67, 68 are placed on body 12 adjacent secondary and primary lighting units 41, 40, respectively, on light transmissive panels 61, 62, respectively, so that indicia 67, 68 are transilluminated by lighting units 41, 40, for improved visibility. Appropriate openings in body 12, to allow for both the mounting of panels 61, 62 and the passage of light from the respective lighting units, are provided.

Transmissive panels 61, 62, which may be transparent or translucent, are preferably made of a plastic material such as acrylic, and are preferably removable to allow the indicia to be changed easily. The indicia may be painted onto the panels, especially if the indicium is substantially permanent, like the room number. If the indicium is temporary, it may be applied to the panel, e.g., by affixing adhesive characters, or by "magic marker." The characters may be removable, and the panels reused, or the panels may be disposable.

Although as shown in FIG. 6, indicia 67, 68 are adjacent different ones of lighting units 40, 41, they could be interchanged or both indicia may be provided adjacent either of lighting units 40 or 41. In a particularly preferred embodiment, discussed in more detail below, at least indicium 67, bearing the permanent information, is adjacent lighting unit 41.

Figure 8:
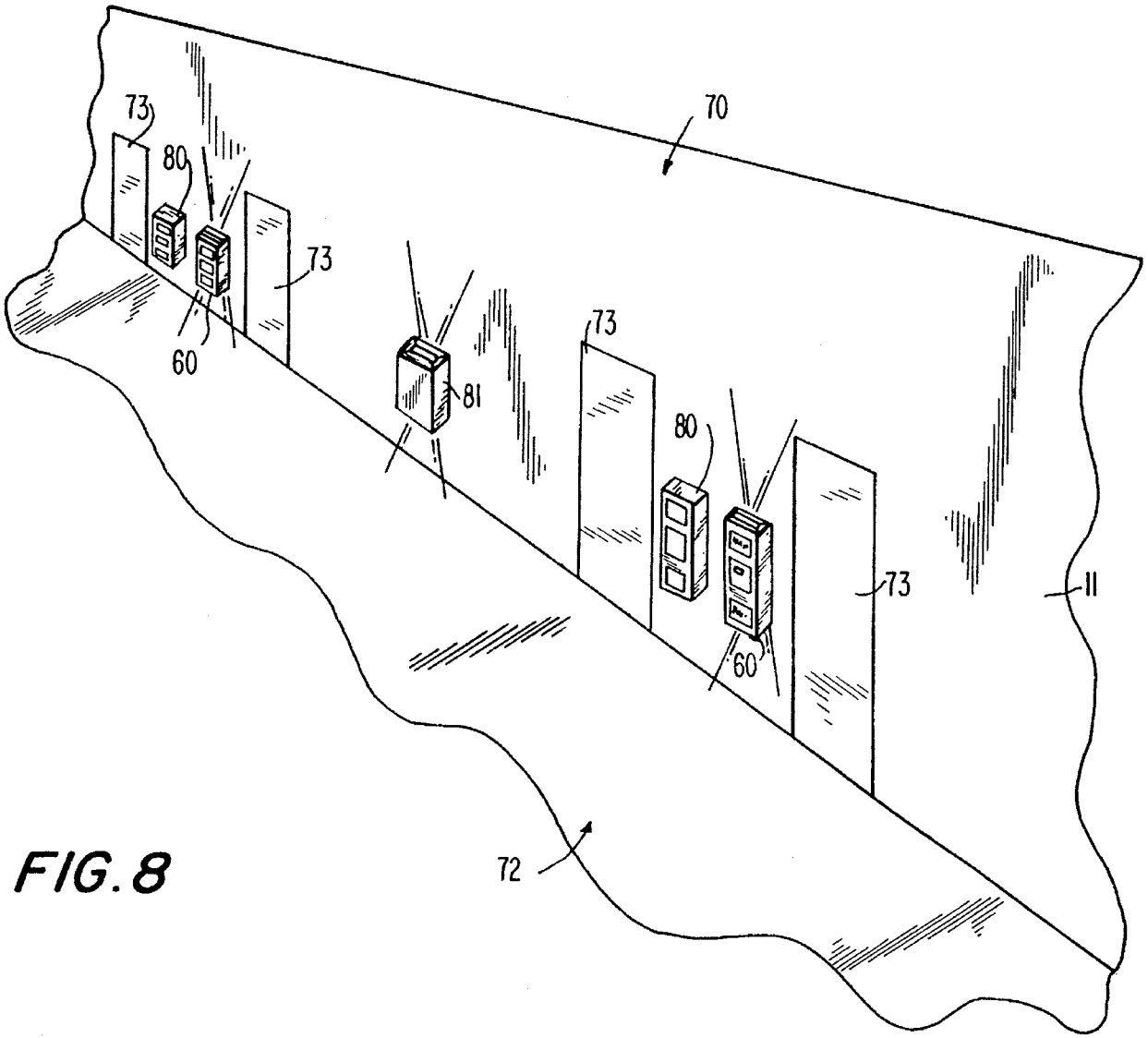
FIG. 8 is a perspective view of a portion of a corridor equipped with the lighting/information system of FIG. 7.

FIGS. 7 and 8 show a preferred embodiment of a corridor lighting system 70 according to the present invention, using lighting/information units 60 as system lighting/information modules and other lighting and information modules as described below. System 70 is installed in a corridor 72 leading to rooms 71.

Rooms 71 are arranged in a configuration in which each particular room has a floor plan that is the mirror image of the floor plan of each adjacent room. As a result, the room doors 73 are clustered in groups of two along one wall, with two other doors directly opposite on the other wall, and relatively long stretches of wall between doors. For the reasons described above, then, only one room in each group of two rooms might be provided with a lighting/information module 60. The adjacent room in the same group of two rooms could then be provided with an information-only module 80 which may have the same appearance as lighting/information module 60 but is not equipped with lighting units 40, 41. Similarly, as discussed above, lighting-only modules 81 are provided approximately midway between groups of doors. Modules 81 have the appearance of modules 60, and have lighting units 40, 41, but lack the information features of modules 60 and 80.

In system 70, primary lighting units 40 are shown schematically connected to a normal power supply 74. Secondary lighting units 41 are connected through relay 75 to both normal power supply 74 and emergency power supply 76. Thus, both primary and secondary lighting units 40, 41, provide normal lighting for the hospital or other facility. The corridors of the facility are illuminated by plentiful indirect lighting, rather than by glaring overhead fixtures.

When relay 75 senses a failure of normal power supply 74, it disconnects secondary lighting units 41 from normal power supply 74 and connects them to emergency power supply 76, providing uniformly distributed emergency lighting. At the same time, indicia 67 remain illuminated, even under the emergency lighting conditions. It is for that reason that it is preferred that at least one of indicia 67, 68 be placed adjacent lighting unit 41. Preferably, the permanent indicium, such as the room number, would be placed there where it can be illuminated even in emergencies.

In system 70 as shown in FIGS. 7 and 8, only every other room number (or other indicium) would be lighted under emergency conditions, because half of all rooms would have information-only modules. In a more particularly preferred embodiment (not shown), such as where doors 73 are uniformly spaced along corridor 72, every room would have a module 60, and thus every room number would remain lighted. Other combinations of lighting/information modules, lighting-only modules and information-only modules could be used, as required by the configuration of the facility in which the system is installed.

Thus it is seen that a corridor lighting system for a hospital or other facility that provides plentiful indirect lighting, a better distribution of emergency lighting in the corridors of the facility, a room identification marker that is legible even under emergency lighting conditions, and secure patient chart storage that allows a physician to retrieve and study a patient's chart before entering the room, has been provided. One skilled in the art will appreciate that the present invention can be practiced by other than the described embodiments, which are presented for purposes of illustration and not of limitation, and the present invention is limited only by the claims which follow.

What is claimed is:

1. A lighting/information unit for mounting at a location on a wall of a building interior space, said unit comprising:

a body for mounting on said wall;

a first light source within said body for projecting light substantially upward and illuminating said space;

a second light source within said body for projecting light substantially downward and illuminating said space indicia on said unit, said indicia containing additional information related to said location.

2. The lighting/information unit of claim 1 further comprising:

a compartment within said body for storing information related to said location; and a closure for said compartment, said closure being operable from said space for opening and closing said compartment.

3. The lighting/information unit of claim 1 wherein at least a portion of said indicia is at least partially transmissive of light and is positioned adjacent one of said light sources for transillumination thereby.

4. The lighting/information unit of claim 2 wherein:

said building is a medical facility, said space is a corridor in said medical facility, and said location is adjacent a patient room; and said compartment is for storing medical records of a patient in said patient room.

5. The lighting/information unit of claim 1, wherein:

said building is a medical facility, said space is a corridor in said medical facility, and said location is adjacent a patient room; and said indicia contain additional information related to said patient room, said additional information comprising at least one of a room number and a name of patient in said room.

6. The lighting/information unit of claim 5 wherein at least a portion of said indicia is at least partially transmissive of light and is positioned adjacent one of said light sources for transillumination thereby.

7. The lighting/information unit of claim 1 wherein:

one of said first and second light sources serves as primary lighting for said space and is brighter than the other of said first and second light sources; and the other of said first and second light sources serves as secondary lighting for said space.

8. The lighting/information unit of claim 7 wherein:

said first light source serves as primary lighting for said space and is said one of said light sources that is brighter; and said second light source serves as secondary lighting for said space.

9. The lighting/information unit of claim 2 further comprising a second closure for said compartment, said second closure being operable from a second space separated by said wall from said building interior space.

10. A lighting/information system for a building interior space, said system comprising a plurality of modules mounted at locations on walls of said space, said plurality of modules comprising at least one lighting/information module at one of said locations, said lighting/information module comprising:

a body for mounting on said wall and having a body shape, a first light source within said body for projecting light substantially upward and illuminating said space, a second light source within said body for projecting light substantially downward and illuminating said space indicia on said at least one lighting/information module, said indicia containing additional information related to said location.

11. The lighting/information system of claim 10 wherein said at least one lighting/information module further comprises:

a compartment within said body for storing information related to said one of said locations; and a closure for said compartment, said closure being operable from said space for opening and closing said compartment.

12. The lighting/information system of claim 10 wherein at least a portion of said indicia is at least partially transmissive of light and is positioned adjacent one of said light sources for transillumination thereby.

13. The lighting/information system of claim 11 wherein:

said building is a medical facility, said space is a corridor in said medical facility, and said location is adjacent a patient room; and said compartment is for storing medical records of a patient in said patient room.

14. The lighting/information system of claim 10 wherein:

said building is a medical facility, said space is a corridor in said medical facility, and said location is adjacent a patient room; and said indicia contain additional information related to said patient room, said additional information comprising at least one of a room number and a name of patient in said room.

15. The lighting/information system of claim 14 wherein at least a portion of said indicia is at least partially transmissive of light and is positioned adjacent one of said light sources for transillumination thereby.

16. The lighting/information system of claim 10 wherein:

one of said first and second light sources serves as primary lighting for said space and is brighter than the other of said first and second light sources; and the other of said first and second light sources serves as secondary lighting for said space.

17. The lighting/information system of claim 16 wherein:

said first light source serves as primary lighting for said space and is said one of said light sources that is brighter; and said second light source serves as secondary lighting for said space.

18. The lighting/information system of claim 10 further comprising:

a normal power supply; and an emergency power supply; wherein:

one of said first and second light sources is connected to said normal power supply and serves as normal lighting for said space; and the other of said first and second light sources is connected to said emergency power supply and functions as emergency lighting for said space.

19. The lighting/information system of claim 18 wherein said other of said first and second light sources is also connected to said normal power supply and also serves as normal lighting for said space.

20. The lighting/information system of claim 18 wherein:

said first light source is said one of said first and second light sources that is connected to said normal power supply; and said second light source is said other of said first and second light sources that is connected to said emergency power supply.

21. The lighting/information system of claim 10 further comprising at least one lighting module, said lighting module consisting essentially of:

a body for mounting on said wall and having said body shape;

a first light source within said body for projecting light substantially upward and illuminating said space; and a second light source within said body for projecting light substantially downward and illuminating said space.

22. The lighting/information system of claim 10 further comprising at least one information module at another location in said space, said information module consisting essentially of:

a body for mounting on said wall and having said body shape;

a compartment within said body for storing information related to said another location; and a closure for said compartment, said closure being operable from said space for opening and closing said compartment.

23. The lighting/information system of claim 22 wherein:

said building is a medical facility, said space is a corridor in said medical facility, and said location is adjacent a patient room; and said compartment is for storing medical records of a patient in said patient room.

24. The lighting/information system of claim 10 further comprising at least one information module at another location in said space, said information module consisting essentially of:

a body for mounting on said wall and having said body shape;

a compartment within said body for storing information related to said another location;

a closure for said compartment, said closure being operable from said space for opening and closing said compartment; and indicia containing additional information related to said another location.

25. The lighting/information system of claim 24 wherein:

said building is a medical facility, said space is a corridor in said medical facility, and said another location is adjacent a patient room;

said compartment is for storing medical records of a patient in said patient room; and said indicia contain additional information related to said patient room, said additional information comprising at least one of a room number and a name of patient in said room.

26. The lighting/information system of claim 11 further comprising a second closure for said compartment, said second closure being operable from a second space separated by one of said walls from said building interior space.

* * * * *